United States Patent [19]

Mullen

[11] 4,120,187

[45] Oct. 17, 1978

[54] FORMING CURVED SEGMENTS FROM METAL PLATES

[75] Inventor: Roger F. Mullen, Foxboro, Mass.

[73] Assignee: General Dynamics Corporation, St. Louis, Mo.

[21] Appl. No.: 800,037

[22] Filed: May 24, 1977

[51] Int. Cl.[2] ..... B21D 11/00

[52] U.S. Cl. ..... 72/342; 148/12.4; 148/130

[58] Field of Search ..... 72/342, 364; 148/12.4, 148/130

[56] References Cited

U.S. PATENT DOCUMENTS

| | | | |
|---|---|---|---|
| 2,428,825 | 10/1947 | Arnoldy | 148/130 |
| 3,745,805 | 7/1973 | Gauthier | 72/364 |

FOREIGN PATENT DOCUMENTS

| | | | |
|---|---|---|---|
| 1,028,853 | 5/1966 | United Kingdom | 72/342 |

*Primary Examiner*—Lowell A. Larson

*Attorney, Agent, or Firm*—Fitch, Even, Tabin & Luedeka

[57] ABSTRACT

A large flat metal plate is formed to have a three-dimensional shape of compound curvature by locally heating to an elevated temperature along predetermined lines and then quickly cooling, as by using a torch which carries a water spray nozzle. The heating extends completely through the thickness of the plate, and cooling causes significant shrinkage in the plane thereof in a direction perpendicular to the line of heating. Heating is carried out along lines in a geometric pattern and in a preselected sequence involving all quadrants of the plate so that it experiences a gradual transformation overall. The plate is normally supported upon an underlying cradle shaped to the desired compound curvature.

11 Claims, 5 Drawing Figures

FORMING CURVED SEGMENTS FROM METAL PLATES

This invention relates to the forming of curved metal plates and more particularly to the forming of large, relatively thin metal plates into three-dimensional shapes of compound curvature.

One method presently used for forming metal plates into three-dimensional shapes of compound curvature is by die-pressing either at ambient or elevated temperatures. Forging and pressing is another method that is used. In some instances, rolling operations have been employed using complex, special-purpose rollers to achieve compound curvature. Still another way is to first produce a simple, two-dimensional curve by means of conventional rolling and then adding curvature in an additional direction (sometimes called back-setting) by pressing, forging or the like.

However, unless the size of the plates being formed is relatively small or the number of identical plates required for a particular job is quite large, these processes are inherently quite expensive, and thus alternative methods have been sought. There have been attempts made to form plates by heating with gas torches; however, such attempts have relied upon a rotational effect which is created by differential heating so that one surface of the metal object is heated to a greater depth than the opposite surface. Generally, one side of the plate shrinks more than the other side causing the plate to bend along the line of heating thereby creating bending in this direction. U.S. Pat. No. 2,428,825 issued Oct. 14, 1947 to Arnoldy is illustrative of such a method.

It has now been found that, if such differential heating is substantially eliminated so that a relatively uniform temperature is achieved along a narrow band, the phenomenon of "in-plane shrinkage" can be used to form large, relatively thin metal plates to three-dimensional shapes of compound curvature. Heating may be performed using acetylene gas torches or the like to rapidly heat the plate along a narrow band, and before the heat is dissipated throughout the plate from such narrow band, cooling is quickly effected. Heating is carried out in a predetermined geometric line pattern depending upon the type of projection being employed; for instance, heating may be along straight, parallel lines of varying length extending inward from the edges of the plate. For mild steel plate where it is desirable to avoid changing the mechanical properties of the metal, its temperature is raised to the vicinity of about 1000° F., and the heating is preferably carried out in a predetermined sequence which causes the transformation in shape to progress as evenly as possible throughout the entire plate. Normally, such a transformation is effected by a sequence wherein heating is performed first along the lines of intermediate length, and then along the progressively longer and shorter lines.

The invention will be understood from the following detailed description of certain methods embodying various features of the invention when read in conjunction with the accompanying drawings wherein.

The forming method is considered to be suitable for use with plates of different metals; however, it is expected to find its greatest commercial application for forming or shaping steel plates. Generally, the method would not be employed to shape plates having a heat conductivity greater than that of aluminum because the phenomenon is dependent upon the ability to achieve a uniform high temperature in a relatively narrow band which can be quickly cooled. The forming method is most efficiently practiced upon steel plate of a thickness between about $\frac{3}{8}$ inch and $1\frac{1}{4}$ inch and is expected to find its greatest application in the shaping of plates of iron alloys more than $\frac{1}{4}$ inch thick. When fairly thick steel plate is used, it may be preferable to heat simultaneously and quickly cool from both surfaces of the plate along the line in question so as to achieve the desired relative uniformity of temperature while still restricting the heating to a relatively narrow band. Mild steel plates may be shaped by heating to above about 800° F., and although temperatures approaching the melting point may theoretically be used, if it is desired to avoid a change in the mechanical properties of the steel, a temperature above about 1300° F. is not used.

The method is particularly suited for the formation of very large plates, weighing about a thousand pounds or more, which are to be a part of large metal structures, for example, hulls or other major ship components, large chemical plant installations, such as tanks, reactors and the like, and other such large curved metal structures. As indicated, the purpose of the method is to form a three-dimensional shape having compound curvature. For purposes of definition, a simple two-dimensional curved surface is defined as one where there are an infinite number of planes whose intersection with the surface is a straight line, e.g., a cylinder or cone. A three-dimensional, compound-curved surface is defined as one where the intersection with any plane is a curved line, for example, surfaces which are spherical, ellipsoidal, paraboloidal and hyperboloidal.

Figure 1:
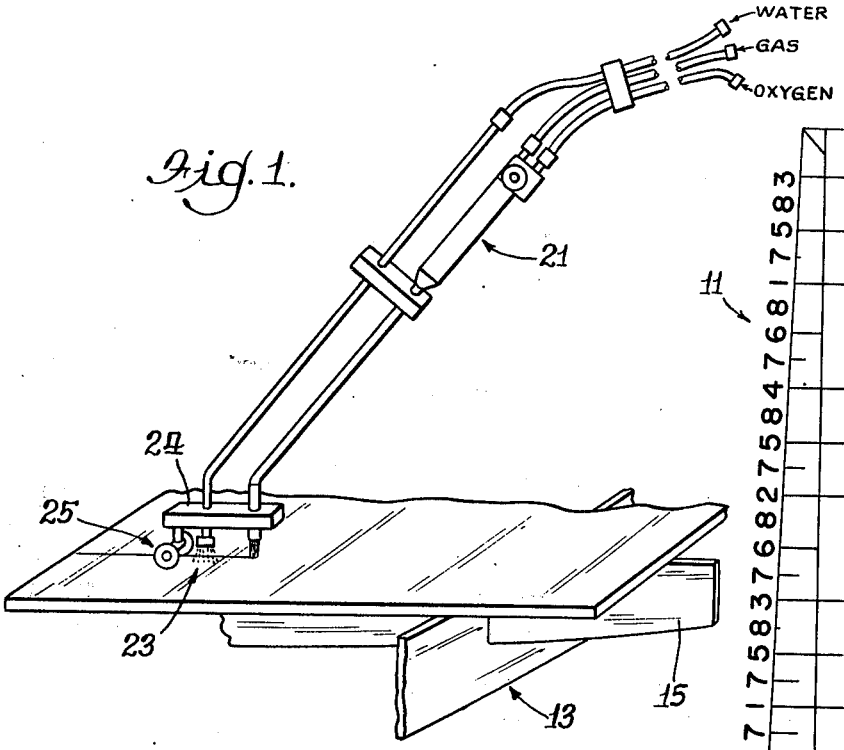
FIG. 1 is a fragmentary perspective view showing line heating of a flat plate being carried out with the plate supported upon a suitable cradle.
Figure 4:
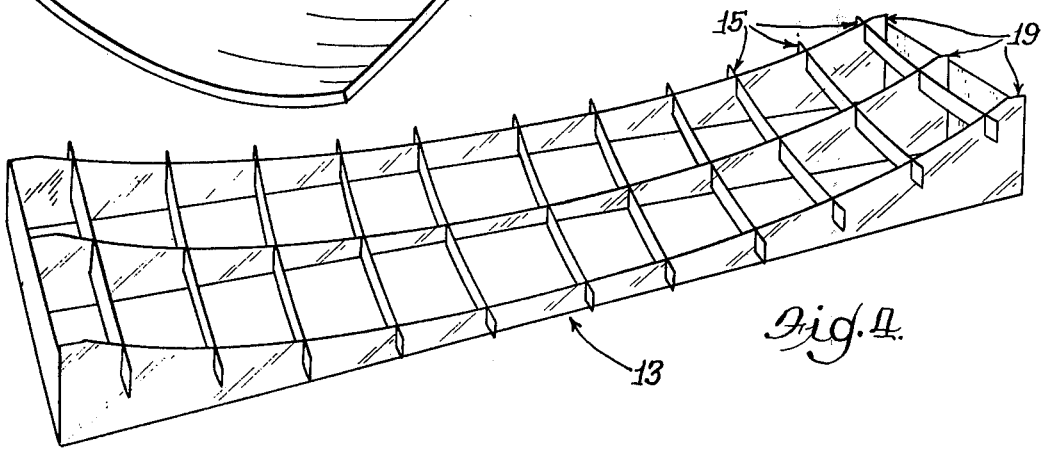
FIG. 4 is a perspective view of the cradle shown in FIG. 1.

Because of the size and weight of the usual plate 11 being formed, it is usual that it is supported atop a cradle 13, as illustrated in FIGS. 1 and 4, and preferably the cradle 13 is designed to have the precise compound curvature of the final curved section. The cradle supports the plate 11 such that its periphery is totally unrestrained, so as not to interfere with the in-plane shrinkage which will occur in a direction at right angles to each line of heating. The cradle 13 is simple in design being made of a plurality of transverse frames 15 each cut to have an upper surface 17 of precise curvature and a series of longitudinal members 19 which interconnect the frames 15 into a rigid, support framework. Although the shaping can be carried out with the plate in any orientation, e.g., vertical, by placing the plate in a generally horizontal disposition upon a cradle, the force of gravity is relied upon to assist the curvature creation in shaping the plate to an upwardly concave section. With such a cradle arrangement, if heating is to be carried out from only one surface of the plate, the upper surface is conveniently heated.

Heating is carried out using a suitable gas torch 21 that will rapidly bring the plate 11 to the desired temperature (e.g., about 1000° F. for steel) without overheating it. Generally, gas-oxygen torches are used, which burn a suitable gas, such as acetylene or propane. The flame pattern of the torch is adjusted so as to heat only a relatively narrow band along the line where heating is desired, and preferably the flame width is set about equal to or slightly less than the plate thickness. For example, a flame width of about ½ inch may be used for steel plate 9/16 inch in thickness. The phenomenon is based upon achieving a high temperature gradient in the steel and then quickly cooling it. Preferably, the gradient from the center of the heated band outward should be equal to a slope of at least about 500° F. per half inch. Using an acetylene torch with such a flame width, steel can be heated to a uniform temperature throughout of between about 950° F. and 1050° F. with the desired gradient using a torch travel speed of about fourteen inches per minute.

Heating of such very large plates is generally carried out out-of-doors or under roof in large open bays where there is adequate drainage because cooling is effected by means of a water spray. Usually a water spray nozzle 23 is carried by the torch 21, and the heads are joined by a coupling 24 which spaces the nozzle so the cooling automatically follows a predetermined distance behind the heating — generally as close to the flame as possible without interfering with the heating action of the torch. In an arrangement where the rate of travel of the gas-torch head is about that mentioned above, the cooling spray may be directed about 3 to 4 inches behind the flame. The coupling device 24 also preferably includes guide means, such as a pair of guide wheels 25, which support the torch head a desired height above the metal plate. As earlier mentioned, the phenomenon of in-plane shrinkage occurs in a narrow region as a result of first creating a sharp temperature gradient and then rapidly reducing the temperature of the heated metal so as to cause shrinkage to occur in this region and the resultant shrinkage across the heat-line creates the desired curvature at this localized portion of the metal plate. The heating-quencing process has been successfully carried out manually; however, it could be automated if desired.

On any continuous surface, there is a geometry which defines the dimensional relationships between points. On a plane surface, the geometry is the familiar Euclidean one. On any three-dimensionally curved surface, these particular relationships no longer exist; however, there will be another applicable non-Euclidean geometry. It is the incompatibility between two such geometries which makes it impossible to project a three-dimensionally curved surface onto a plane without introducing some distortion. However, the differential relationships (viz, the distortion pattern) between a continuous three-dimensionally curved surface and a plane surface can be determined, and it is these of which advantage is taken in the plate-forming method.

Just as the shape of a surface determines the dimensional relationships between the points on the surface, conversely the dimensional relationships between the points determined the shape of the surface. For instance, if the dimensional pattern of the points on a steel plate can be set to that pattern which exists in spherical geometry, then the plate must assume the shape of a spherical surface as soon as this dimensional pattern is effected because there is no other geometry in which the particular relationship exists. The foregoing is likewise true for other dimensional patterns which might be used to produce an ellipsoidal segment or the like. Accordingly, when it is desired to form a flat plate into, for example, a surface which has the shape of a sphere, a heat-line pattern is developed which will produce differential in-plane shrinkage that is exactly equal in direction and magnitude to the difference in the dimensional relationships (viz, the distortion pattern) between the geometry of the plane projection of the spherical surface and of the spherical surface itself. As a result, when uniform heating along the narrow bands of the heat-line pattern is carried out in the flat plate, the plate forms itself into a spherical surface segment, simply because this is the only geometrical surface which allows the new dimensional pattern to exist.

The pattern is usually laid out on the flat plate 11 by marking the lines of heating with a paint stick or the like. The line pattern will be dependent upon the type of curved surface that it is desired to produce and the particular projection chosen. For example, to produce a saddle-shaped surface, a pattern of circular lines might be used. For a segment of a spherical surface, the lines will be straight; however, the pattern and the outline of the plate will be determined by the type of projection chosen. If an azimuthal projection is used, which is the usual choice if the flat plates are generally square in shape, the lines will extend radially inward from the edges. When the length to breadth ratio exceeds the square root of 2, it is believed most efficient to employ a transverse rectangular projection, where the longitudinal centerline of the plate corresponds to the meridian of the sphere that is tangent to the cylinder upon which the segment is projected. One point in common with different projections is that no straight lines extend across the plate from edge to edge.

Figure 2:
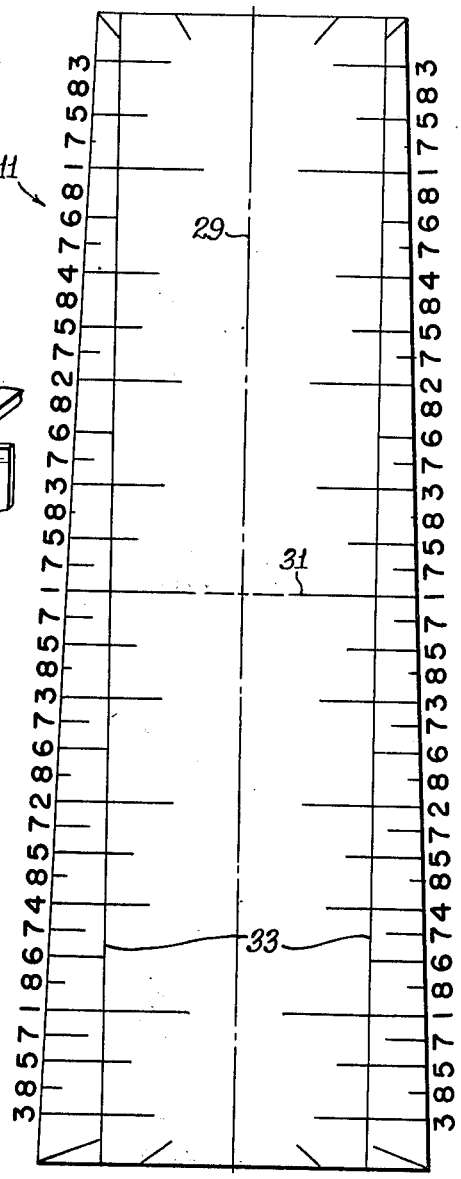
FIG. 2 is a plan view of the plate, prior to any heating, showing the pattern marked on it along which heating will be effected.

As one illustrative example of forming a segment of a hemispherical cover, a pattern of each spherical segment is first determined, and then a transverse rectangular projection is made corresponding to the segments of the spherical surface. One such sample projection is shown in FIG. 2, which depicts a plate blank 11 made of 9/16-inch thick steel which blank is about 29½ feet long, about 8 feet wide at its top, and about 10 feet wide at its bottom. In such a projection, all distortion is parallel to the longitudinal centerline 29, and distortion is zero along the longitudinal centerline. At all other locations, distortion is a function of the reciprocal of the cosine of the angular displacement away from the centerline. Assume, for example, that the radius of the sphere is 776.25 inches, then $k$ is equal to $2\pi R/360 = 13.5481$ inch per degree. If $d$ is equal to the linear distance from the centerline and $\theta$ is equal to the angular distance from the centerline, then $d = k\theta$.

The heat-line pattern is constructed so that the resultant shrinkage pattern is the same as the distortion pattern present in the original flat plate. Because shrinkage occurs in the direction perpendicular to the lines of heating, and because the distortion pattern is longitudinal, the lines of heating are transverse to the longitudinal direction. Heating and cooling can be carried out in either direction along the lines, e.g., from the edge of the plate inward or vice-versa.

A pattern is created using heat-lines of various lengths arranged such that the longitudinal shrinkage within each region or band extending parallel to the longitudinal centerline 29 and spaced a different distance from it will vary approximately as the reciprocal of the cosine of the angular distance from the centerline. The relative lengths of heat-lines will be a function of the radius of the particular sphere; and therefore, the lengths will apply to all sizes and thicknesses of metal plates which are formed by this method. On the other hand, the spacing between individual lines of heating is a function of the amount of shrinkage produced at each line, and thus it will vary with plate thickness. For example, for 9/16-inch thick steel plate, the spacing may be 8 inches, whereas for a thicker plate, for example, ¾-inch steel plate, the spacing will be less, for example, about 6 inches.

In a pattern of parallel lines of various lengths for this illustrative type of projection, there will be a number of regions or bands, perpendicular to the lines, which will contain different numbers of lines per band. To keep the pattern as simple as possible, it is desirable to use a progression of "lines per band" which is reasonably close to the value of $1/\cos\theta - 1$, and it has been found that the use of heat-lines originating at eight different distances from the longitudinal centerline 29 creates a quite accurate pattern without overcomplicating the calculation and marking processes.

To mark a plate of the desired outline with such a pattern, the longitudinal centerline 29 down the middle of the plate, that generally parallels the two longest edges, is first located. This line 29 is then bisected to find the transverse centerline 31, and two longitudinal reference lines 33 may then be marked parallel to the longitudinal centerline. Increments are then marked off along both of the longitudinal reference lines, beginning from the transverse centerline 31, in each direction, with each increment marking providing a reference point for a line of heating. The incremental spacing of these markings varies with the thickness of the metal plate being formed, as indicated above. All of the lines which are marked are straight lines which begin at an edge of the plate and extend less than one-half the distance to the opposite edge.

Once the number of different origin distances to be used has been set, the distance between the origin of the shortest line and the centerline 29 is set at a value that is equal to or slightly less than the half-width of the plate 11 at its transverse centerline 31. For the plate illustrated in FIG. 2, the width at the transverse centerline is about 108 inches, and the origin distance for the shortest line (viz. #8) is set at 54 inches. The origin locations of the other seven lines are then a function of this distance (i.e., 54 in.) and the ratios of "lines per band", and they are each determined mathematically.

Using lines of eight different origin distances, it has been found that the layout pattern should have the following sequence, starting in each direction from the transverse centerline 31 (with #1 representing the longest heat-line and thus the shortest origin distance): 1, 7, 5, 8, 3, 7, 6, 8, 2, 7, 5, 8, 4, 7, 6, 8. By plotting this sequence on the pattern of the predetermined intervals, the total number of lines per band can be found. It can then be shown that the origin distance ($D_n$) for each of the reference lines #1 through #8 can be found by solving the equation wherein the reciprocal of the cosine of the equivalent angular distance ($\theta_n$) is equal to one plus the number of lines per band ($S_n$) times the projected distortion per line. Calculations show the following values:

| Line No. | $S_n$ | $D_n$ |
|---|---|---|
| 1 | 1 | 14" |
| 2 | 2 | 19" |
| 3 | 3 | 23" |
| 4 | 4 | 27" |
| 5 | 6 | 33" |
| 6 | 8 | 38" |
| 7 | 12 | 47" |
| 8 | 16 | 54" |

It can be seen from FIG. 2 that certain of the #8 lines would have their origin beyond the edge of the plate 11, and in such situations the line is simply omitted. It can be seen that all of the heating lines begin at an edge of the plate, and all those along the two longitudinal or major edges extend in generally parallel relationship toward the other longitudinal edge of the plate. The mechanics of the forming process are such that the extreme upper and lower ends of the plate do not receive as much transverse bending force as the main body of the plate, and to compensate for this, a few short diagonal lines 33 are added at the end of each plate 11, as shown in FIG. 2.

After the line heating pattern has been marked onto the plate, heating is begun at the middle-length category lines (#4 lines) and then alternately with the next shortest line category (#5) and then the next longest category (#3) until the pattern is completed. All heat-lines within each category are completed before the next successive category is started, and the geometric pattern is such that it extends into all quadrants of the plate, with lines of each category generally appearing in each quadrant. The heating in this sequence is considered to be advantageous because, at the end of heating along the lines of any one category, the plate will have assumed an overall shape approaching the ultimate desired configuration throughout its entire area avoiding creation of stress in any localized region. Accordingly, such a gradual overall transformation is preferred rather than completing all the heating in one quadrant before moving on to the next.

Figure 3:
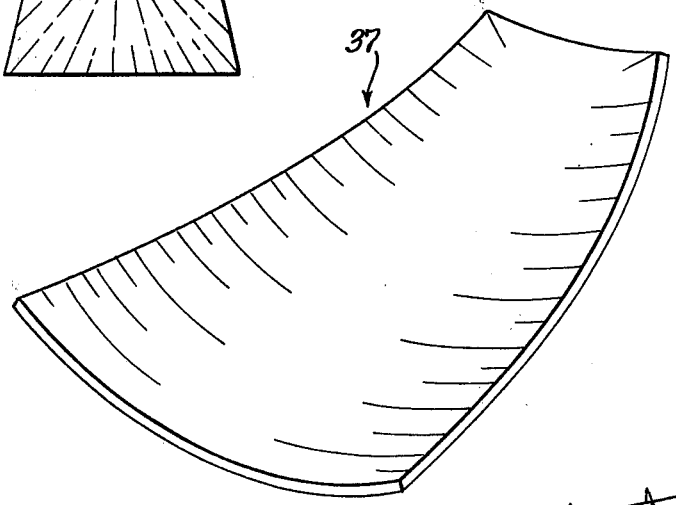
FIG. 3 is a perspective view showing the spherical segment which is formed from the plate of FIG. 2 as a result of the heating method.

Generally, the diagonal end lines 33 are heated during the fairly early stages of the process, and preferably the heating along the end lines is carried out subsequent to heating along the #5 lines. The above-identified sequence is used for a spherical segment and might be varied somewhat for a nonspheridal surface; however, the principle of achieving gradual overall transformation remains the same. Following the heating of the last lines, which will be the #8 lines, the steel plate has assumed the shape of a spherical surface segment 37 as illustrated in FIG. 3.

Figure 5:
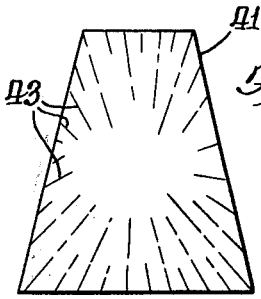
FIG. 5 is a view similar to FIG. 2 of a plate marked with an alternative pattern for forming a slightly different shape of compound curvature.

Depicted in FIG. 5 is a plate 41 which is marked with a pattern of lines 43 which is generally representative of forming a segment of a sphere based upon an azimuthal projection. The line pattern for an azimuthal projection is such that the heating lines extend generally radially from the center of the plate to an edge of the plate 41, and all of the lines 43 stop short of the center of the plate so that no line extends completely across the plate. The same sequence for heating and quenching would be used, with heating first being carried out along the lines of intermediate length.

Although the invention has been described with respect to certain preferred embodiments, it should be understood that various changes as would be obvious to one having the ordinary skill in the art may be made without departing from the scope of the invention which is defined solely by the appended claims. For example, although the employment of flat plates is generally contemplated because they are most readily available in this form from a manufacturer and because the projection to determine the geometric line pattern is slightly simplified, the inventive forming method can begin with plates of other shapes, e.g., a section of a cylinder, and the overall concept remains unchanged. Various of the features of the invention are set forth in the claims which follow.

What is claimed is:

1. A method of forming a metal plate to have a three-dimensional shape of predetermined compound curvature, which method comprises locally heating a metal plate to an elevated temperature along a relatively narrow band by moving a heat source along a predetermined line at a rate such that said heating extends completely through the thickness of said plate, quickly cooling said plate along said line following said heating so that significant shrinkage occurs within the plane of said plate in a direction substantially perpendicular to said line of heating, and repeating said heating and cooling steps along additional lines in a preselected geometric pattern arranged throughout all regions of the plate which pattern is derived from the linear distortion which is inherent in the projection of the predetermined compound curvature onto said metal plate whereby the total result of said in-plane shrinkage is that said plate assumes said predetermined compound curvature.

2. A method in accordance with claim 1 wherein said plate is a steel plate and said elevated temperature is above 800° F. and below 1300° F.

3. A method in accordance with claim 1 wherein a flat plate is initially disposed in a substantially horizontal orientation and with its periphery unrestrained.

4. A method in accordance with claim 3 wherein said plate is supported upon an underlying cradle which is constructed to receive and support a segment of a surface having said desired compound curvature.

5. A method in accordance with claim 1 wherein said heating along lines in said geometric pattern is carried out in a preselected sequence involving all quadrants of said plate so that said plate experiences a gradual transformation overall to said desired compound curvature.

6. A method in accordance with claim 1 wherein said three-dimensional shape is that of a sphere and wherein said lines of heating begin at the edges of said plate and extend in a straight line a distance less one-half the distance to the opposite edge.

7. A method in accordance with claim 6 wherein said geometric pattern is based upon a transverse rectangular projection and wherein said predetermined lines are generally parallel and of different lengths, all of said lines terminating short of the longitudinal centerline of said plate.

8. A method in accordance with claim 7 wherein said heating is carried out in a preselected sequence and along the lines of intermediate length before said heating is carried out along the longest and the shortest lines.

9. A method in accordance with claim 1 wherein said heating is carried out simultaneously along said lines from both surfaces and wherein said cooling is effected from both surfaces of said plate.

10. A method in accordance with claim 1 wherein said heating in said relatively narrow band is such as to create a temperature gradient of at least about 500° F. over a width of ½ inch in a direction perpendicular to the direction of heating.

11. A method in accordance with claim 10 wherein said plate is made of steel and wherein said heated portion of said plate reaches a temperature between about 950° F. and 1050° F.

* * * * *